US010428509B2

(12) United States Patent
Smith et al.

(10) Patent No.: US 10,428,509 B2
(45) Date of Patent: Oct. 1, 2019

(54) PRE-PRIMED SIPHONIC TOILET

(71) Applicant: Kohler Co., Kohler, WI (US)

(72) Inventors: Andrew L. Smith, Sheboygan, WI (US); Billy Jack Ahola, Manitowoc, WI (US); Mark Baumgartner, Sheboygan, WI (US); Larry Duwell, Adell, WI (US); Don Bogenschuetz, Sheboygan, WI (US); Peter Swart, Oostburg, WI (US); Tobin Vetting, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/981,457

(22) Filed: May 16, 2018

(65) Prior Publication Data

US 2018/0258630 A1 Sep. 13, 2018

Related U.S. Application Data

(62) Division of application No. 15/360,434, filed on Nov. 23, 2016, now Pat. No. 9,988,802.

(51) Int. Cl.

| | |
|---|---|
| ***E03D 11/18*** | (2006.01) |
| ***E03D 5/02*** | (2006.01) |
| ***E03D 11/02*** | (2006.01) |
| ***E03D 5/10*** | (2006.01) |
| ***E03D 11/10*** | (2006.01) |
| ***E03D 5/00*** | (2006.01) |

(52) U.S. Cl.

CPC ..... *E03D 11/18* (2013.01); *E03D 5/024* (2013.01); *E03D 5/10* (2013.01); *E03D 11/02* (2013.01); *E03D 11/10* (2013.01); *E03D 5/003* (2013.01); *E03D 2201/30* (2013.01)

(58) Field of Classification Search

CPC ..... E03D 11/00
USPC ..... 4/328
See application file for complete search history.

(56) References Cited

U.S. PATENT DOCUMENTS

| | | | |
|---|---|---|---|
| 168,613 | A | 10/1875 | Carr |
| 209,996 | A | 11/1878 | Wellington |
| 234,570 | A | 11/1880 | Hellyer |
| 270,335 | A | 1/1883 | Hendricks |
| 279,048 | A | 6/1883 | Tweeddale |
| 283,172 | A | 8/1883 | Walsh |
| 289,495 | A | 12/1883 | Bennor |
| 299,333 | A | 5/1884 | Birkett |
| 717,651 | A | 1/1903 | Allen |
| 1,157,989 | A | 10/1915 | Harvey |
| 1,232,767 | A | 7/1917 | Camfield |
| 2,341,043 | A | 2/1944 | Hoffmann |

(Continued)

FOREIGN PATENT DOCUMENTS

| | | |
|---|---|---|
| CN | 2533164 Y | 1/2003 |
| CN | 101666115 | 3/2010 |

(Continued)

*Primary Examiner* — Lori L Baker
(74) *Attorney, Agent, or Firm* — Foley & Lardner LLP

(57) ABSTRACT

A method of flushing a siphonic toilet that includes retaining a first volume of water in a bowl and an up leg of a passageway that is upstream from a dam, retaining a second volume of water in the passageway between a valve and the dam in a closed position of the valve, activating a flush cycle of the toilet that introduces a third volume of water into the toilet, and moving the valve from the closed position to an open position to affect a siphon during the flush cycle.

20 Claims, 10 Drawing Sheets

(56) References Cited

U.S. PATENT DOCUMENTS

| | | | |
|---|---|---|---|
| 3,214,772 | A | 11/1965 | Roberts |
| 3,224,013 | A | 12/1965 | Tubbs |
| 3,599,248 | A | 8/1971 | Fulton |
| 3,663,970 | A | 5/1972 | Drouhard |
| 3,922,729 | A | 12/1975 | Ashley |
| 3,965,492 | A | 6/1976 | Hendricks |
| 4,016,609 | A | 4/1977 | Graham |
| 4,086,668 | A | 5/1978 | Tubbs |
| 4,155,129 | A | 5/1979 | Russell |
| 5,201,082 | A | 4/1993 | Rockwell |
| 5,271,105 | A | 12/1993 | Tyler |
| 5,345,618 | A | 9/1994 | Sigler |
| 5,539,938 | A | 7/1996 | Tubbs |
| 6,212,700 | B1 | 4/2001 | Giesler |
| 6,279,176 | B1 | 8/2001 | Aviles |
| 6,332,229 | B1 | 12/2001 | O'Malley |
| 6,467,101 | B1 | 10/2002 | Furlan |
| 7,284,286 | B1 | 10/2007 | Kopplin |
| 7,861,331 | B2 | 1/2011 | Grech et al. |
| 8,230,533 | B2 | 7/2012 | Jorsch |
| 8,615,822 | B2 | 12/2013 | Vargas |
| 8,677,519 | B2 | 3/2014 | Ina et al. |
| 8,701,220 | B2 | 4/2014 | Vargas |
| 2001/0052147 | A1 | 12/2001 | Lee |
| 2011/0113542 | A1 | 5/2011 | Stauber |
| 2014/0059755 | A1 | 3/2014 | Garrels |
| 2014/0259350 | A1 | 9/2014 | Davis |
| 2015/0197928 | A1 | 7/2015 | McHale |
| 2016/0047113 | A1 | 2/2016 | Orubor |

FOREIGN PATENT DOCUMENTS

| | | | |
|---|---|---|---|
| CN | 102359166 | | 2/2012 |
| CN | 102587473 | | 7/2012 |
| EP | 1124021 | A1 | 8/2001 |
| FR | 359559 | A | 3/1906 |
| GB | 601812 | | 5/1948 |
| JP | H10292890 | | 11/1998 |
| JP | 2001207509 | | 8/2001 |
| JP | 2006112057 | | 4/2006 |
| NL | 1023302 | | 11/2004 |
| WO | WO9311311 | A1 | 6/1993 |
| WO | WO9741315 | A1 | 11/1997 |

PRE-PRIMED SIPHONIC TOILET

CROSS-REFERENCE TO RELATED APPLICATIONS

The present application is a Divisional of U.S. patent application Ser. No. 15/360,434, which was filed on Nov. 23, 2016, and is incorporated by reference herein in its entirety.

BACKGROUND

The present application relates generally to the field of siphonic toilets. More specifically, this application relates to a siphonic toilet and methods of flushing such siphonic toilets that involves pre-priming a passageway prior to a flush cycle to improve the siphon during the flush cycle.

SUMMARY

At least one embodiment relates to a siphonic toilet that includes a bowl, a passageway, an inlet, and a valve. The passageway includes an entrance, an outlet, and a dam located between the entrance and the outlet. The entrance is fluidly connected to the bowl, and the bowl and the dam are configured to hold a first volume of water prior to a flush cycle of the toilet. The inlet is located in the passageway downstream from the dam, and the inlet is configured to introduce water into the passageway downstream from the dam. The valve is located between the inlet and the outlet of the passageway, and the valve retains a second volume of water in a closed position prior to the flush cycle to affect a siphon during the flush cycle. The valve can be any type of valve that retains water and release water on command.

At least one embodiment relates to a siphonic toilet that includes a passageway and a valve. The passageway is fluidly connected to a bowl, and the passageway includes an up leg and an outlet leg. The up leg extends from the bowl to a dam so that a first volume of water is retained in the up leg and the bowl prior to a flush cycle of the toilet. The outlet leg extends from the dam toward an outlet. The valve is located between the up leg of the passageway and the outlet, and the valve is configured to retain a second volume of water (when the valve is) in a closed position (e.g., prior to the flush cycle of the toilet) to affect a siphon during the flush cycle. The passageway may (e.g., optionally) include an inlet in the passageway, where the inlet is disposed in the passageway downstream from the dam to introduce the second volume of water into the passageway downstream from the dam.

At least one embodiment relates to a method of flushing a siphonic toilet. The method includes retaining a first volume of water in a bowl and an up leg of a passageway that is upstream from a dam. The method includes retaining a second volume of water in the passageway between a valve and the dam with the valve in a closed position. The method includes activating a flush cycle of the toilet that introduces a third volume of water into the bowl, and moving the valve from the closed position to an open position to affect a siphon during the flush cycle.

The second volume of water may be introduced into the passageway using a flow control device prior to activating the flush cycle through an inlet located downstream of the dam and upstream from the valve.

The method may include venting (e.g., releasing) air through an air pressure release line extending between a first opening in the passageway and a second opening in the passageway. The first opening may be located upstream from the inlet and downstream of the dam. The second opening may be located downstream of the valve. The valve may be configured to seal off the second opening, such as when the valve is in the open position. The valve may be configured to expose the opening, such as when the valve is in the closed position.

At least one embodiment relates to a method of flushing a siphonic toilet that includes retaining a first volume of water upstream of a dam of a passageway, which fluidly connects an outlet of a bowl and an outlet of the siphonic toilet; retaining a second volume of water in the passageway downstream of the dam through a valve located between the dam and the outlet of the siphonic toilet; activating a flush cycle that introduces a third volume of water into at least one of the bowl and the passageway; and moving the valve from a closed position to an open position to affect a siphon during the flush cycle.

DETAILED DESCRIPTION

Figure 1:
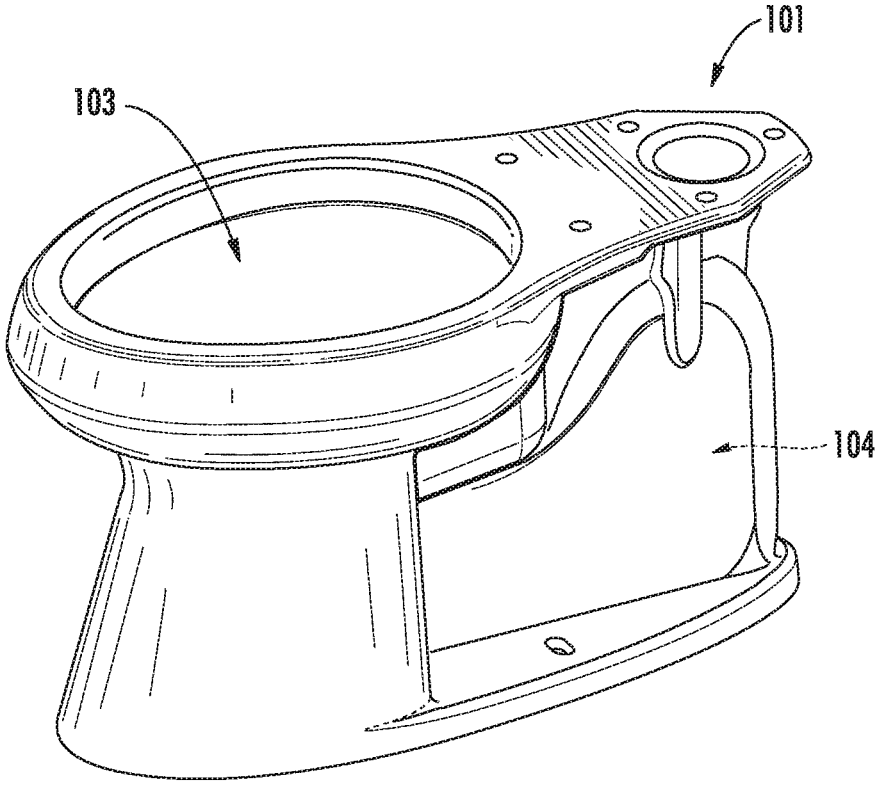
FIG. 1 is a perspective view of an exemplary embodiment of a pre-primed siphonic toilet.

Referring generally to the Figures, disclosed in this application are siphonic toilets that are pre-primed prior to a flush cycle to improve the siphon during the flush cycle. As discussed below in more detail, the toilets of this application may advantageously be configured, for example, to use less water during a flush cycle and/or decrease the time it takes to complete a flush cycle. The toilets may advantageously be configured to eliminate the need for a tank containing the water, which reduces cost and the size of the toilet. The performance of toilets of this application advantageously are not affected by changes in line pressure, unlike tankless toilets operating purely on line pressure (e.g., household line pressure), which can vary by 10 psi or more. This advantageously allows the toilets of this application to eliminate the use of electric pumps, which are used to increase line pressure.

For example, the toilets of this application improve how the siphon is created/induced, such as by pre-priming the siphon before each flush cycle is activated. A volume of water is introduced into a passageway (e.g., trapway, trap, etc.) of the toilet, and the water remains in the passageway until a user flushes the toilet (e.g., activates a flush cycle). Other siphonic toilets prime the siphon after the flush cycle is activated by introducing water directly into the bowl, which then must make its way (e.g. flow) to the trap at a flow rate that is greater than a threshold in order for a siphon to occur. One problem with these toilets is that waste can block the opening to the trapway and impede the siphon by reducing the flow of water from the bowl to the trapway below the threshold, which in-turn reduces the effectiveness of the flush.

The toilets disclosed in this application include a passageway with a valve (e.g., located proximate an outlet of the passageway) for pre-priming the system. As used herein, the term "pre-prime" denotes that the water is introduced into the passageway in advance of (e.g., prior to, before, etc.) activation of a flush cycle, as opposed to "priming" which is performed after activation (e.g., initiation) of a flush cycle. Thus, the systems disclosed herein hold the pre-primed water in the passageway and, therefore, remain primed while the system is idle (i.e., between flush cycles). When the toilet is used (e.g., activated, flushed, etc.) and the system is actuated, a series of functions will initiate. According to an exemplary embodiment, actuating a flush cycle triggers water to flow from the rim or one or more rim jets for a predetermined amount of time, the valve in the passageway opens (e.g., after the predetermined amount of time), the mixture of waste and water is expelled from the system, then the valve closes, and the system refills the bowl with a first volume of water and pre-primes the passageway with a second volume of water for the next flush cycle.

According to another exemplary embodiment, the system can be integrated with a "grey water" system. The term "grey water" as used herein includes sources of water other than fresh water (e.g., clean water, potable water that is typically safe for consumption by people and may be subject to various regulations, treatment requirements, etc.), such as unpurified water that has been captured (e.g., rainwater, salt water, etc.), recycled water (e.g., used shower and/or bath water, dishwasher, clothes washer, etc.), and other sources of non-potable water (e.g., city sourced "purple pipe" non-potable water, etc.). For example, the term "grey water" as used herein includes, but is not limited to, unpurified water such as captured rainwater, recycled water from another appliance and/or plumbing fixture, such as a shower, bath, dishwasher, sink, washing machine, etc., and the like. Toilets that use grey water to feed the entire toilet system are not attractive to many consumers because the user is exposed to the sight and smell of the grey water, which is visible in the toilet bowl. Additionally, these toilets having grey water flowing through the whole system can require extra cleaning and maintenance.

The toilets disclosed in this application may be configured such that the user is not exposed to the grey-water. For example, the toilets herein may use grey water only to fill the passageway that is downstream of a dam (e.g., weir, etc.). Further, the toilets herein may be more environmentally friendly, such as by using less water (e.g., fresh water). The grey water introduced into the passageway downstream of the dam equates directly into less fresh water used during each flush cycle. Moreover, the toilets disclosed herein may be configured such that the bulk (e.g., majority) of water used during each flush cycle is introduced to pre-prime the flush cycle and, therefore, can be grey water. Thus, the toilets may be configured to use fresh water only for refilling and rinsing the bowl. The toilets of this application could reduce the usage of fresh water down to 0.25 gallons per flush, or even lower. For example, the toilets may be configured to use 0.25 gallons (or less) of fresh water and 1.0 gallon (or more) of grey water resulting in 1.25 gallons of total water per flush cycle. This is on par with or even better than current HET Water Sense® certified toilets, which function at 1.28 gallons per flush or less. This is also a 20% (twenty percent) reduction in water usage from the current government standard of 1.6 gallons per flush.

Attention to the figures will now be turned and a description of the embodiments disclosed therein will be provided.

Figure 2:
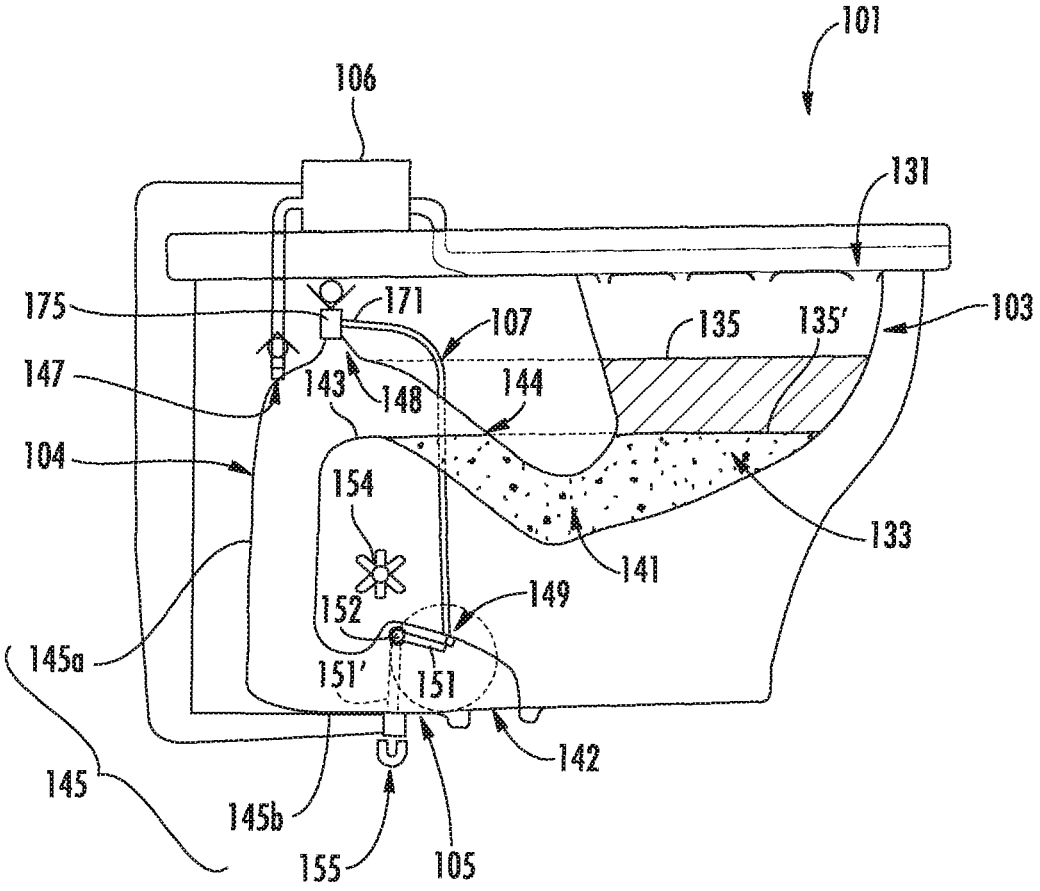
FIG. 2 is a schematic side view of the toilet shown in FIG. 1.

FIGS. 1 and 2 illustrate an exemplary embodiment of a pre-primed siphonic toilet 101 that includes a bowl 103, a passageway 104 (e.g., trapway, trap, waste conduit, etc.) fluidly connected to the bowl 103 and configured to transfer water and waste from the toilet 101, and a valve 105 in the passageway 104 for retaining a volume of water in the passageway to pre-prime the toilet 101.

The bowl 103 includes an inlet opening 131, which may be defined by a rim of the toilet 101. Waste may be introduced into the bowl 103 through the opening and water may be introduced into the bowl 103 through the rim or in another suitable way. The bowl 103 also includes a sump 133 at the bottom of the bowl 103 for retaining a volume (e.g., a first volume) of water, as well as any waste prior to a flush cycle. FIG. 2 illustrates an exemplary embodiment of a fill line 135 (e.g., water line, etc.) to which water may be filled prior to flushing, such as by pre-priming a toilet that is configured for use with only fresh water (i.e., without grey water). The fill line 135 is above the height of the dam 143, so the passageway could be pressurized to increase the height of the fill line above the dam without increasing the height of the water line in the passageway 104 to be higher than the height of the dam 143. This arrangement may be advantageous, for example, if grey water is used to pre-prime the passageway 104 (e.g., to fill the outlet leg 145 or a portion thereof) to avoid commingling the grey water (in the outlet leg) and the fresh water (in the bowl and inlet leg). FIG. 2 also illustrates another exemplary embodiment of a fill line 135' to which water may be filled prior to flushing, such as, for example, if the toilet does not pressurize the passageway 104. The fill line 135' is configured to be no higher than the height of the dam 143 to avoid water from passing over the dam 143 from the inlet leg 144. It should be noted that the systems, as disclosed herein, could be used to create a vacuum assist toilet. For example, with the valve closed, a vacuum could be induced, such as by increasing pressure in the system then opening the valve.

Water may be introduced into the bowl using one or more rim channel holes (e.g., openings, orifices, etc.), one or more jets, a combination of holes and jets, or any other suitable manner. The toilet 101 may include a flow control (e.g., the flow control 106) for controlling (e.g., metering) the water introduced into the bowl.

As shown best in FIG. 2, the passageway 104 includes a first end 141 (e.g., an entrance), which is fluidly connected to the bowl 103, and a second end 142 (e.g., an outlet), which is configured to direct water and waste from the passageway and/or from the toilet, such as into a drain pipe. The passageway 104 includes a dam 143 that is located between the first and second ends 141, 142. The dam 143 is elevated above (e.g., at a height that is higher relative to) the bottom of the bowl 103, such that the dam 143 and the bowl 103 (e.g., the sump 133) hold (e.g., retain, store, etc.) a volume (e.g., first volume) of water (along with any waste) prior to a flush cycle of the toilet.

The passageway 104 may be configured having an inlet leg 144 (e.g., an up-leg) and an outlet leg 145. The inlet leg 144 may extend from the bowl 103 to the dam 143, such that the first volume of water is retained in the inlet leg 144 and the bowl 103 prior to a flush cycle of the toilet 101. The outlet leg 145 may extend from the dam 143 toward an outlet, such as the outlet at the second end 142. The outlet leg 145 may include a first portion 145*a* (e.g., a down leg) that extends generally downward from the dam 143 to a second portion 145*b* (e.g., a horizontal leg, a cross leg, etc.) that extends at an angle relative to the first portion 145*a*. For example, the second portion 145*b* may be configured to extend generally horizontally, such that the second portion 145*b* is generally orthogonal to the first portion 145*a*. As shown in FIG. 2, the valve 105 and the outlet (e.g., in the second end 142) are located in the second portion 145*b* of the outlet leg 145. According to other examples, the passageways may have other configurations and the valve 105 may be located in the down leg and the outlet may be located in the down leg or the cross leg.

As shown in FIG. 2, the passageway 104 includes an inlet 147 into the passageway at a location that is upstream from the valve 105 and downstream from the dam 143 to introduce a volume of water (e.g., grey water, fresh water, etc.) into the outlet leg 145 of the passageway 104. The volume of water introduced through the inlet 147 may be a second volume of water, which is used to pre-prime the toilet, such as when the first volume of water is retained in the inlet leg 144 and the bowl 103. The inlet 147 may be located in an upper side (e.g., at the top) of the passageway 104 to utilize gravity to pull the water into the outlet leg 145. It is noted that the passageway 104 does not have to include the inlet 147 and, according to other examples of passageways, the water retained by the valve 105 is introduced through the up leg of the passageway from the bowl. For example, the volume of water in the sump may be overfilled so that the excess water flows over the dam and into the passageway downstream of the dam to be retained by the valve. The inlet 147 is particularly advantageous for the system utilizing grey water, since locating the inlet 147 downstream of the dam contains the grey water in the waste side of the passageway (e.g., downstream of the dam) and prevents or prohibits the grey water from entering the bowl.

Also shown in FIG. 2, a fluid conduit connects a flow control to the inlet 147 to supply the pre-prime water into the passageway 104. The flow control that supplies the pre-prime water may be the flow control 106 that supplies water to the bowl, such as for an embodiment utilizing fresh water in both the bowl and for the pre-priming. According to other examples, the flow control that supplies the pre-prime water may be a second flow control that is different than the flow control 106 (which may be a first flow control) that supplies water to the bowl. For example, the second flow control may be configured to supply grey water to pre-prime the passageway 104, and the first flow control may be configured to supply fresh water to the bowl 103.

The valve 105 is located in the passageway 104 and is configured to move (e.g., pivot, rotate, slide, translate, etc.) between a closed position and an open position. As shown best in FIG. 2, the valve 105 includes a flapper 151 that rotates by a predetermined angle about a pivot 152 between the open and closed positions. In the closed position, the valve 105 retains the pre-prime water (e.g., the second volume of water) in the passageway 104 for use during the next flush cycle. Thus, the flapper 151 is sized to seal off the opening in the passageway 104 through which the water and waste flow. Water and waste are free to flow through the passageway 104 and out the outlet (e.g., at the second end 142) when the valve 105 is in the open position. The valve 105 is opened to affect a siphon during the flush cycle of the toilet 101.

As shown in FIG. 2, the valve 105 is located in the second portion 145*b* of the outlet leg 145 of the passageway 104. The valve 105 may be located proximate to the outlet (e.g., at the second end 142). This arrangement may advantageously allow for the passageway 104 to hold additional water (e.g., grey water, fresh water) due to the expanded volume to affect a siphon relatively soon after initiation of (e.g., activating) a flush cycle. According to the examples in which the valve 105 is located in a cross leg that extend generally horizontally, the valve 105 (e.g., the flapper 151) is configured to extend generally vertically when in the closed position. The valve 105 may be configured to move from the closed position to the open position during the flush cycle to affect the siphon, such that the valve 105 covers (e.g., to seal) the second opening 149 in the passageway 104 in the open position and exposes (e.g., to allow fluid communication) the second opening 149 in the closed position.

According to other examples, the valve 105 may be located in the down leg of the outlet leg 145, such as the first portion 145*a*. The location of the valve 105 may be tailored to the volume of water used to pre-prime the passageway 104. For example, for long passageways having larger volumes, the valve 105 may be moved farther away from the outlet (e.g., at the second end 142) and closer to the dam 143, such as to retain a predetermined total flush volume (e.g., 1.25 gallons).

According to an exemplary embodiment, the valve is moved (e.g., rotated, pivoted, actuated, etc.) between open and closed positions using an electromagnet. As shown in FIG. 2, the electromagnet 155 is located below a bottom of the passageway 104 (where the flapper 151' is located in the closed position). The electromagnet imparts a magnetic force that rotates the valve 105 between the open and closed positions. The magnetic force may be applied to the pivot 152 and/or the flapper 151. The electric power for controlling the electromagnet may be supplied by a power supply that is internal (e.g., within the toilet 101) or external, such as from the electric grid. According to an exemplary embodiment, the electric power is provided by an internal battery (e.g., 9V) that is removable and replaceable. According to another example, the electromagnet may be located at the pivot 152 to rotate the flapper 151 through the pivot 152.

The toilet 101 may include a manual control for operating the valve 105, such as in the event of power failure. As shown in FIG. 2, a knob 154 is provided to allow the valve 105 to be opened and closed when the knob 154 is rotated. The knob 154 can be configured to rotate the valve 105 directly or indirectly, such as through a gear train (e.g., a gear reduction, etc.).

Other devices may be used to move the valve, such as, for example, solenoids, motors (e.g., an electric motor), and other devices suitable to move the valve. The valve 105 may be controlled by any suitable device or in any suitable manner. For example, the valve 105 may be controlled by fluid (e.g., hydraulic, water, etc.) pressure, such as by a hydraulic piston that is driven by the water used with the toilet, or pneumatic (e.g., air) pressure. Water from the water supply to the toilet may open and close the valve 105. Using the existing water pressure to control the valve may advantageously eliminate the need to use electric power and incorporate devices that use electric power in the toilet. These toilets can be used without external power sources.

The toilet 101 may include a release line 107 that is configured to release pressure (e.g., air pressure) from one portion of the system to another portion of the system. For example, the toilet 101 may include a release line 107 that vents to the drain pipe or the outlet of the passageway 104 that is fluidly connected with the drain pipe to act as a seal and/or keep gases from escaping. As shown in FIG. 2, the release line 107 extends between a first opening 148 in the passageway 104 and a second opening 149 in the passageway 104. The release line 107 may release pressure from the portion of the passageway 104 proximate the first opening 148 to the portion of the passageway 104 proximate the second opening 149 and/or from the portion proximate the second opening 149 to the portion proximate the first opening 148. The release line 107 may be a one-way line allowing pressure to be released in only one direction, or may be a two-way line allowing pressure to be released in two (e.g., opposite) directions.

The release line 107 includes a first end 171 and a second end 172. The first end 171 is coupled to the passageway 104 such that the release line 107 is fluidly connected to the passageway 104 (e.g., at a first portion) through the first opening 148 and the first end 171. The second end 172 is coupled to the passageway 104 such that the release line 107 is fluidly connected to the passageway 104 (e.g., at a second portion) through the second opening 149 and the second end 172.

As shown, the first opening 148 in the passageway 104 is located upstream from the valve 105 and the second opening 149 in the passageway 104 is located downstream of the valve 105. This arrangement may advantageously permit air pressure to be released when the valve 105 is closed and a volume of water is in the passageway 104 upstream from the valve 105. As shown, the first opening 148 is located upstream from the inlet 147 in the passageway 104.

The toilet 101 may include a check valve 175 located in line with the release line 107 to prevent water and waste from back flowing. For example, the check valve 175 may be located proximate the first opening 148 of the passageway 104 and/or the first end 171 to prevent water and waste from flowing into the release line 107 through the first opening 148 (and down toward the second opening 149 and/or the second end 172). The check valve 175 may allow air to flow, such as, for example, from the second opening 149 to the first opening 148 (and out into the passageway 104 through the first opening 148) while preventing water and waste (e.g., liquids, solids) from flowing from the first end 171 toward the second end 172.

Although FIG. 1 depicts a partially skirted toilet 101, the concepts (e.g., pre-primed concepts) of the siphonic toilets disclosed in this application can be incorporated into any other type of toilet as well. For example, the concepts of the siphonic toilet disclosed herein can be incorporated into fully skirted toilets, wall-mount toilets, smart toilets, as well as any other toilet.

Figure 3:
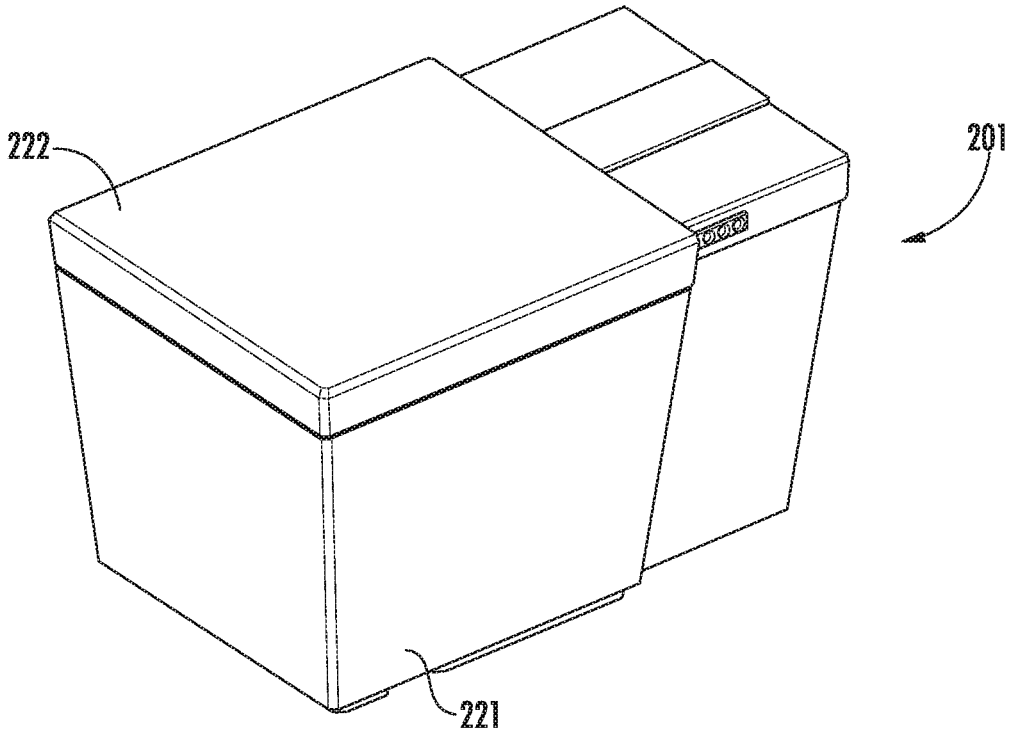
FIG. 3 is a perspective view of another exemplary embodiment of a pre-primed siphonic toilet.
Figure 4:
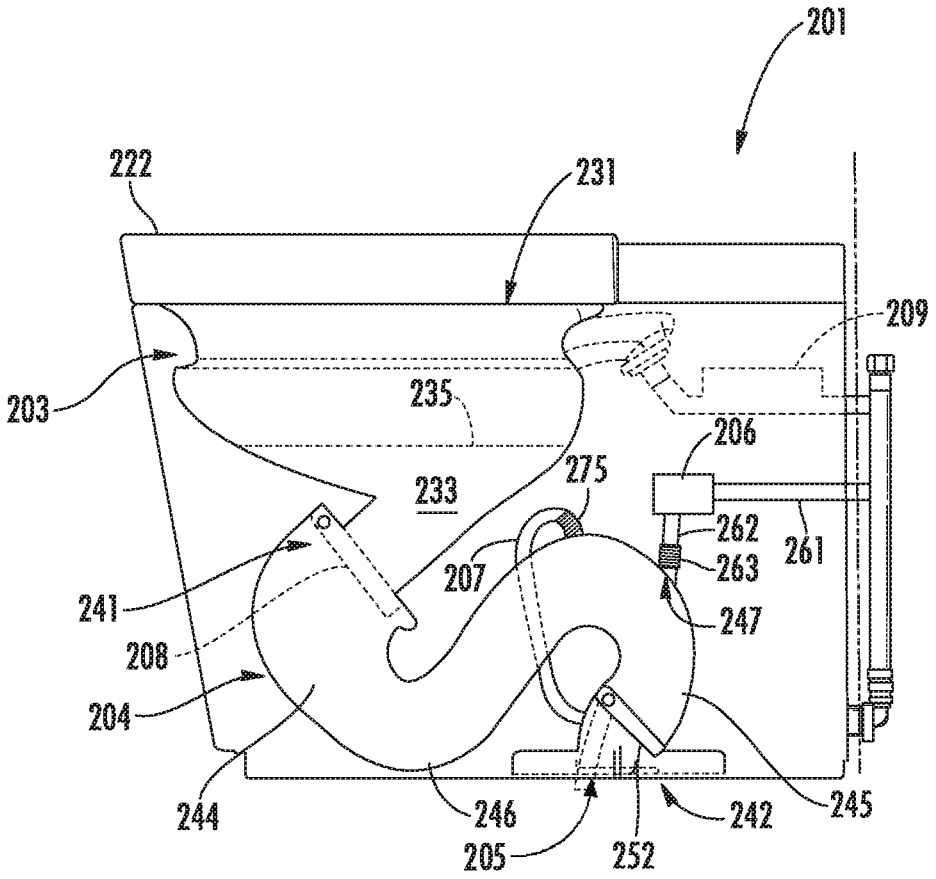
FIG. 4 is a cut-away side view of the toilet shown in FIG. 3.

FIGS. 3 and 4 illustrate an exemplary embodiment of a smart toilet 201 that is configured as a pre-primed siphonic toilet. As shown in FIG. 3, the toilet 201 includes a structure 202 having a base cover 221 and a lid 222 that is movable relative to the base cover 221. The lid 222 can be moved between an open position, which provides access to a bowl 203 of the toilet 201 through a bowl opening 231 (e.g., inlet opening), and a closed position (as shown in FIG. 3). The bowl 203 includes a sump 233, which may be configured to hold a volume of water.

The toilet 201 also includes a passageway 204 that is fluidly connected to the bowl 203. The passageway 204 transfers water and waste from the toilet 201 to an outlet. As shown in FIG. 4, the passageway 204 includes a first end 241, which is fluidly connected to the bowl 203, and a second end 242, which may serve as the outlet of the toilet 201. The passageway 204 includes an inlet leg 244 and an outlet leg 245. Also shown, the inlet leg 244 includes a first portion (e.g., down leg) extending downwardly from the first end 241 to a second portion (e.g., an up leg). The second portion of the inlet leg 244 extends upwardly from a bottom 246 (e.g., trap) of the passageway 204 to a dam (e.g., weir, etc.). The outlet leg 245 extends downwardly from the dam to the outlet (e.g., at the second 242).

The toilet 201 also includes a valve 205 for providing a pre-priming of the toilet for flushing. For example, the valve 205 can be configured to retain a volume of water in the passageway 204 to pre-prime the toilet 201 prior to a flush cycle. The valve 205 is located between the dam and the outlet (e.g., at the second end 242). As shown in FIG. 4, the valve 205 is located proximate the outlet.

The valve 205 includes a gate 252 configured, such as a flat member (e.g., a flapper), to rotate between an open position and a closed position. The closed position of the gate 252 is shown in FIG. 4 using the solid lines, and the open position of the gate 252 is shown in FIG. 4 using the dashed lines. When in the closed position, the gate 252 retains a volume of water in the passageway 204. In an embodiment, water is retained in only the outlet leg 245 (e.g., from the dam downstream to the valve 105) to pre-prime the toilet 201. In another embodiment, water is retained in the inlet leg 244 and the outlet leg 245 (e.g., when the toilet 201 includes a second valve, as discussed below in more detail).

The toilet 201 may include one or more than one flow controller. As shown in FIG. 4, a flow controller 206 is housed in the toilet 201 (e.g., within the base cover 221) to control water flow from an inlet fluid conduit 261 to an outlet fluid conduit 262. The inlet conduit 261 introduces water into the flow controller 206 from a water source (e.g., supply, etc.). The source can be internal (e.g., tank) or external (e.g., water line) to the toilet 201. The outlet conduit 262 introduces water into the outlet leg 245 through the inlet 247 (e.g., opening, entrance, etc.). The flow controller 206 meters (e.g., controls the amount of, to supply in a measured or regulated amount, etc.) the water introduced into the outlet leg 245 as well as the timing of when the water is introduced (e.g., pre-priming). Also shown in FIG. 4, a flow controller 209 is located in the base cover 221 and meters water into the bowl 203 from the water source.

The toilet 201 may include a release line. As shown in FIG. 4, a release line 207 extends between a first opening (e.g., upper opening above the dam) and a second opening (e.g., lower opening proximate the valve 105). The release line 207 may release air pressure, as described above for the toilet 101 (e.g., the release line 107). The toilet 201 may include a check valve 263, 275, as described above for the toilet 101 (e.g., the check valve 175).

The toilet 201 may also include another valve. For example, the toilet 201 may include a second valve 208 to maintain a volume of water in the sump 233 of the bowl 203 (e.g., illustrated by the fill line 235 shown in FIG. 4 using dashed lines) when the second valve 208 is closed. The second valve 208 may be configured to open, such as during a flush cycle, to allow water and waste to flow from the sump 233 into the passageway 204. The second valve 208 may include a rotatable member (e.g., door, flapper, etc.) that rotates about a pivot (e.g., pivot axis, axis of rotation, etc.) between the open and closed positions. The second valve 208 may be advantageous for applications, for example, aimed at reducing water usage by utilizing the pre-prime volume of water in the passageway and the volume of water in the sump to generate a siphon during a flush cycle. The volume of water in the passageway may be reduced (e.g., filling only the outlet leg 245) when retaining the volume of water in the sump by the second valve 208. It is noted that the second valve 208 is optional.

Figure 8:
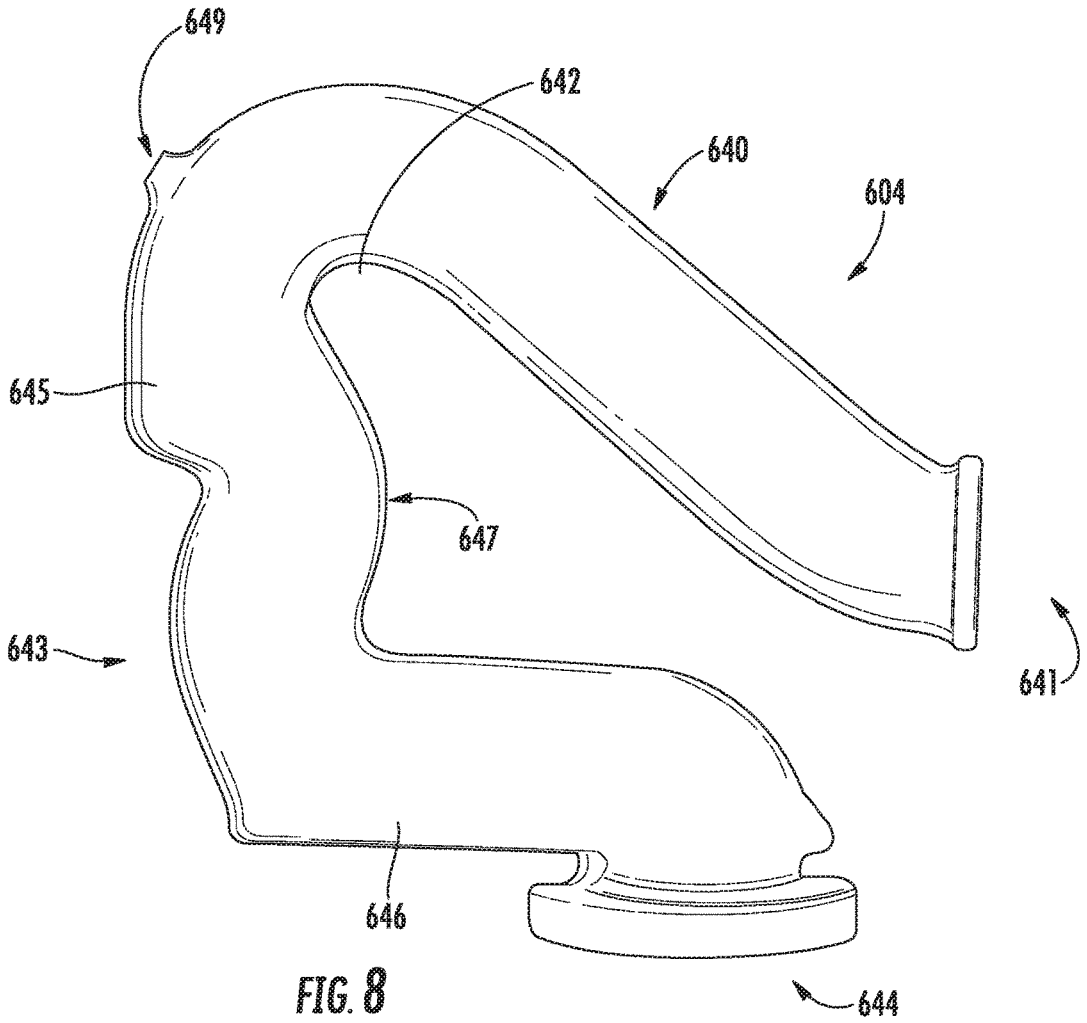
FIG. 8 is a perspective side view of another exemplary embodiment of a passageway for use in a pre-primed siphonic toilet.
Figure 9:
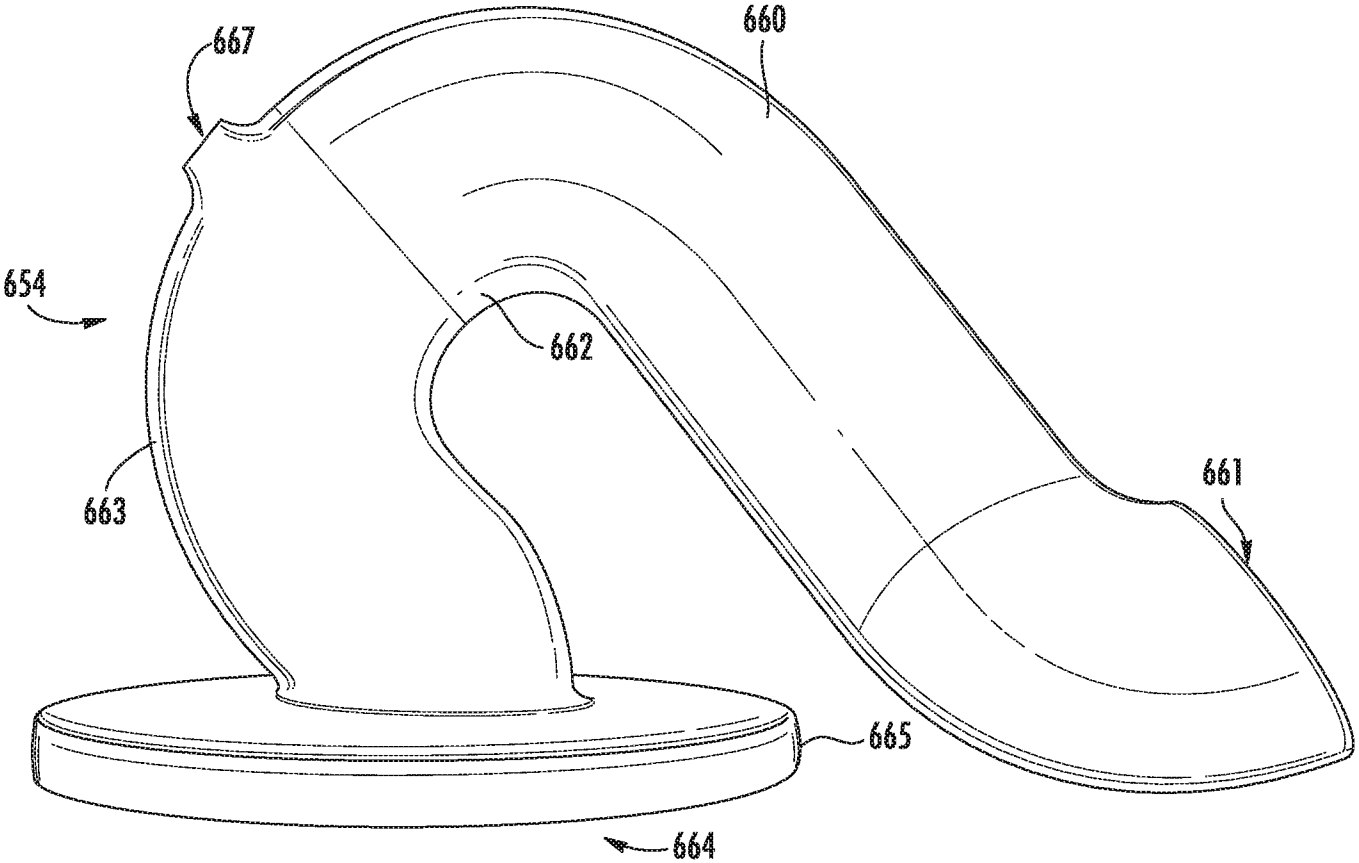
FIG. 9 is a perspective side view of yet another exemplary embodiment of a passageway for use in a pre-primed siphonic toilet.
Figure 10:
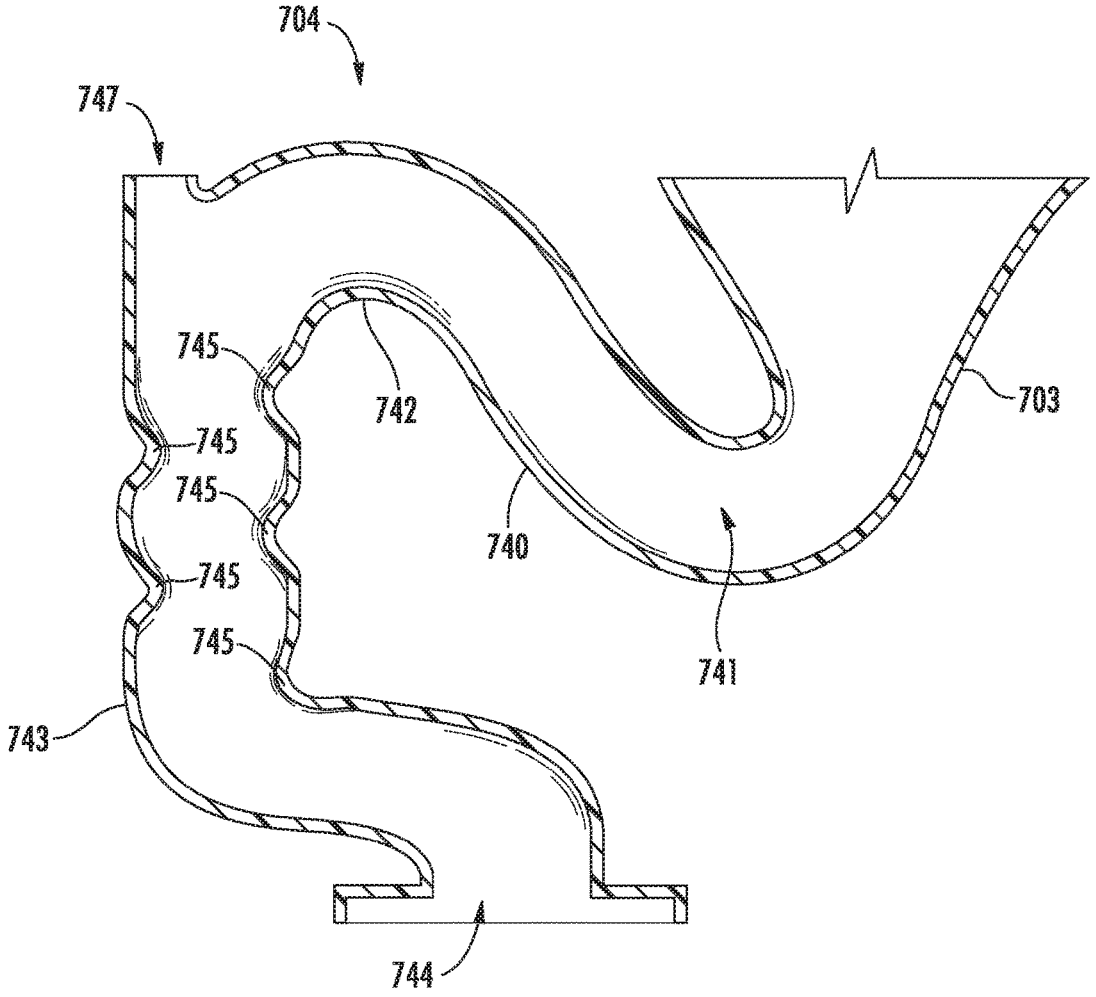
FIG. 10 is a cross-sectional side view of another exemplary embodiment of a passageway and a bowl of a pre-primed siphonic toilet.
Figure 11:
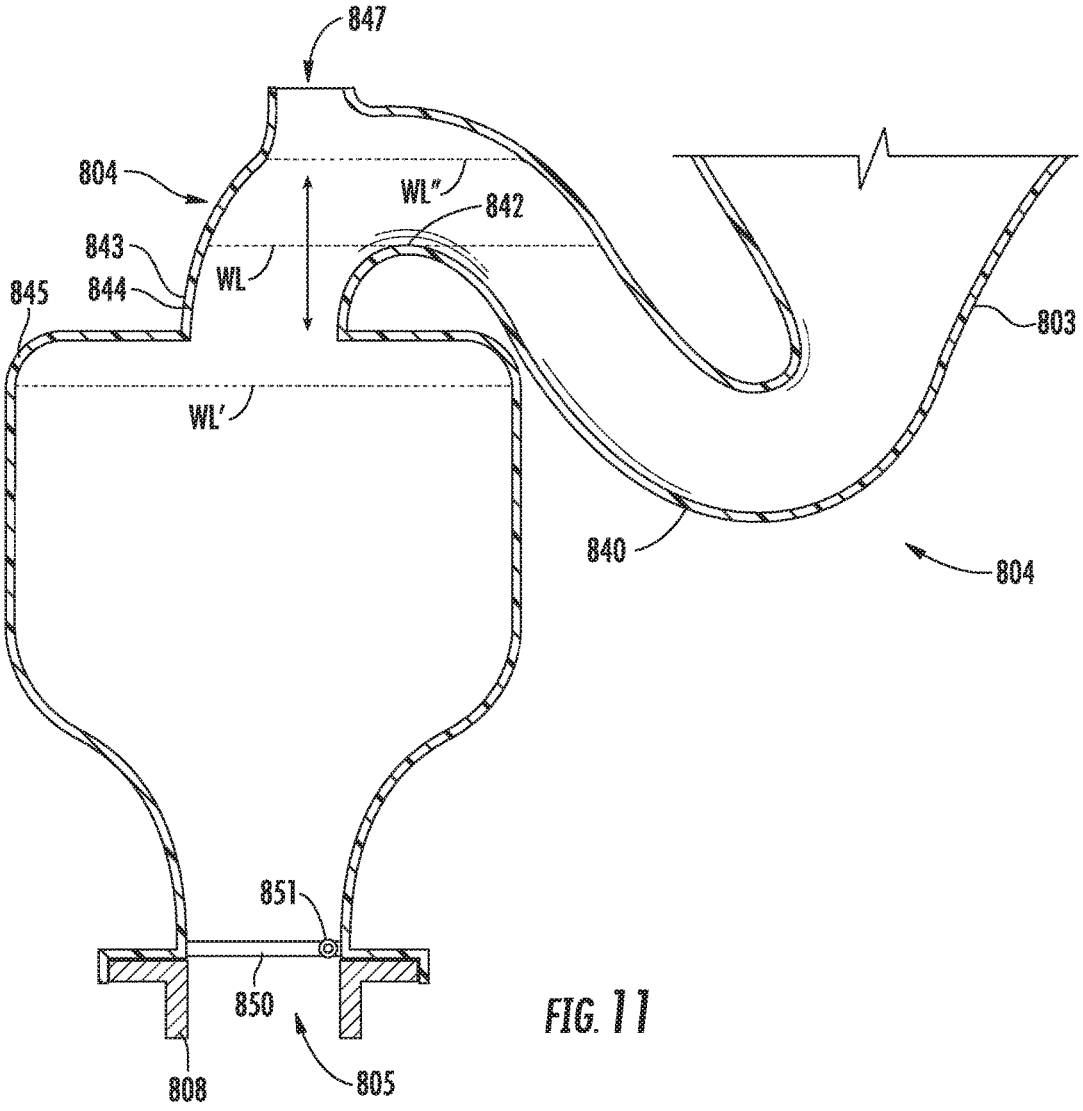
FIG. 11 is a cross-sectional side view of another exemplary embodiment of a passageway and a bowl of a pre-primed siphonic toilet.
Figure 12:
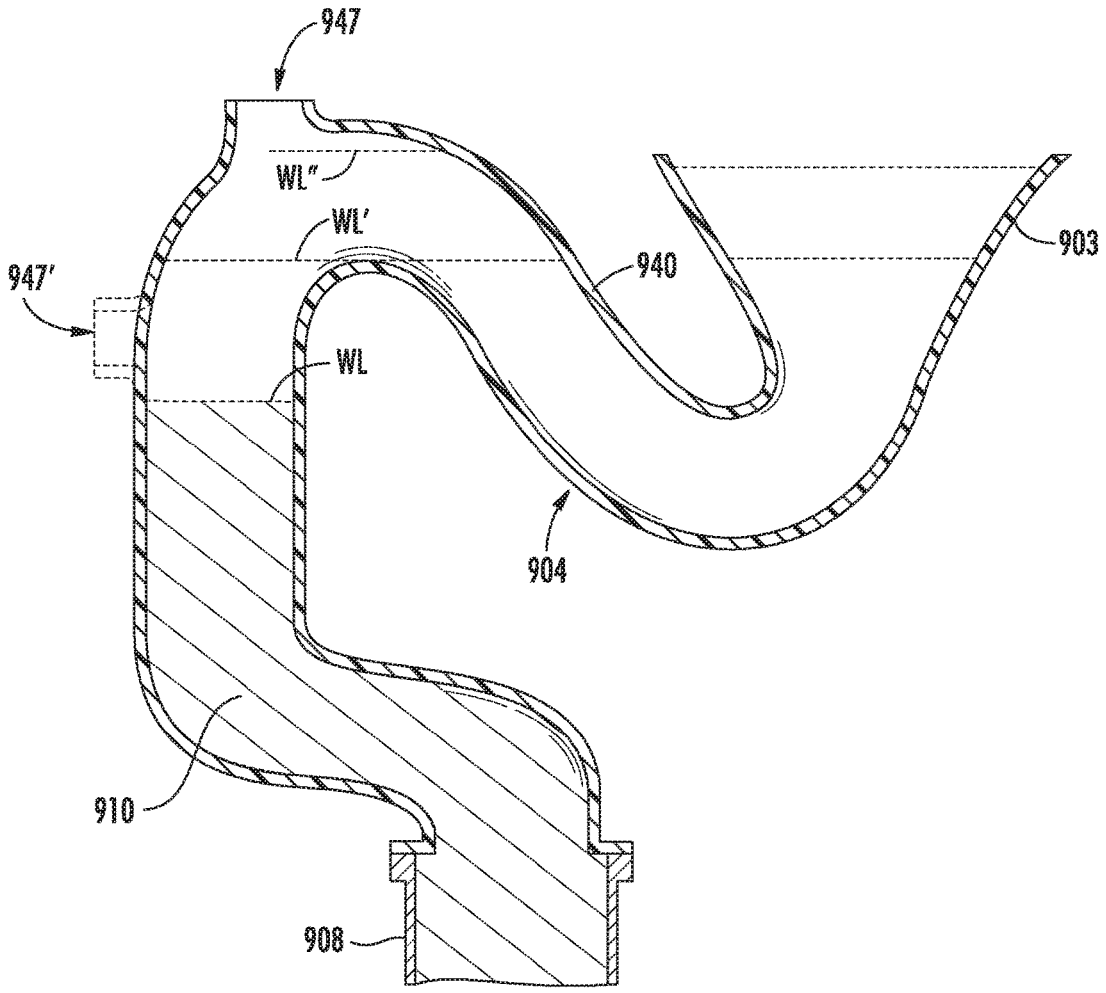
FIG. 12 is a cross-sectional side view of another exemplary embodiment of a passageway, a bowl and a drain pipe of a pre-primed siphonic toilet.

FIGS. 5-12 illustrate various exemplary embodiments of passageways (e.g., traps, trapways, etc.) that are configured for use in the toilets disclosed in this application (e.g., the toilets 101, 201). The passageways may be tubular to fluidly connect a bowl to a drain pipe to transfer water and waste from the bowl to the drain pipe. The passageways may include inlets (e.g., pre-prime inlets) that are configured to introduce water into the passageway to pre-prime the passageway. Valves (e.g., pre-prime valves) may be disposed in the passageways to hold water in the passageway to pre-prime the toilet. FIGS. 5-9 illustrate the passageways alone (i.e., without other elements/features of the toilet), whereas FIGS. 10-12 illustrate the passageways with other elements/features of the toilets.

Figure 5:
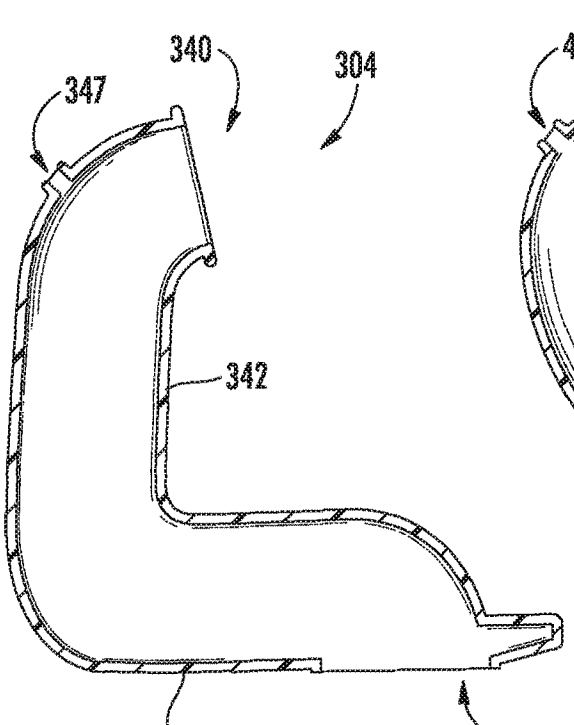
FIG. 5 is a cross-sectional side view of an exemplary embodiment of a passageway for use in a pre-primed siphonic toilet.

FIG. 5 shows a passageway 304 extending from an inlet end 340 to an outlet end 341. The inlet end 340 includes an inlet opening that is generally horizontally aligned. The inlet end 340 opens into (e.g., is fluidly connected with) a down leg 342, which, as shown, extends downwardly. The down leg 342 opens into a cross leg 343, which, as shown, extends horizontally to the outlet end 341. The outlet end 341 includes an outlet that is generally vertically aligned. Disposed in the passageway 304 is a pre-prime inlet 347 that is configured to introduce water into the passageway 304 to pre-prime the passageway 304. As shown in FIG. 5, the pre-prime inlet 347 is disposed upstream from the down leg 342 and downstream from the inlet end 340. It is noted that the pre-prime inlet 347 can be located elsewhere in the passageway 304.

Figure 6:
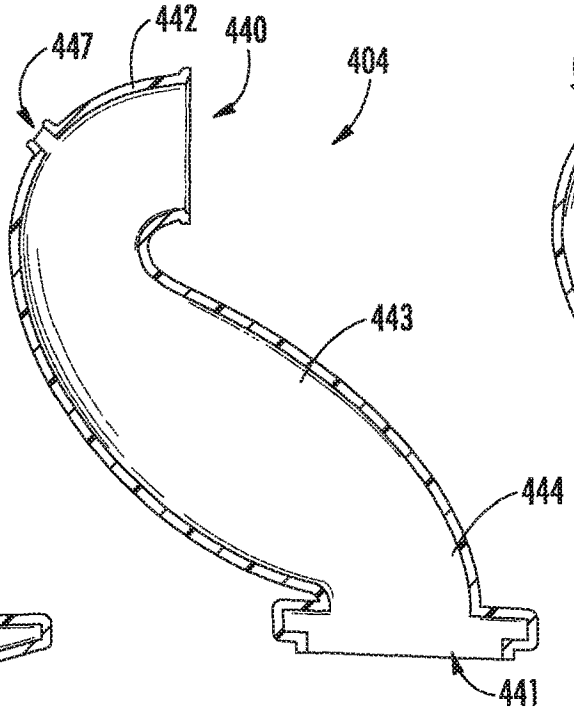
FIG. 6 is a cross-sectional side view of another exemplary embodiment of a passageway for use in a pre-primed siphonic toilet.

FIG. 6 shows a passageway 404 extending from an inlet end 440 to an outlet end 441. The passageway 404 has a generally S-shape. As shown, the passageway 404 includes a semi-circular portion 442 having the inlet opening, a generally straight portion 443 extending from the circular portion 442, and an outlet portion 444 extending from the generally straight portion 443. The outlet portion 444 may be semi-circular or may just turn downwardly to an outlet. As shown, the generally straight portion 443 has a cross sectional shape (e.g., size, area, etc.) that changes along its length. For example, the size of the generally straight portion 443 is relatively smaller at the ends proximate to the semi-circular portion 442 and the outlet portion 444, while the size is relatively larger in the middle section. As shown in FIG. 6, a pre-prime inlet 447 is disposed in the passageway 404 at a location that is upstream from the generally straight portion 443 and downstream from the inlet end 440. It is noted that the pre-prime inlet 447 can be located elsewhere in the passageway 404.

Figure 7:
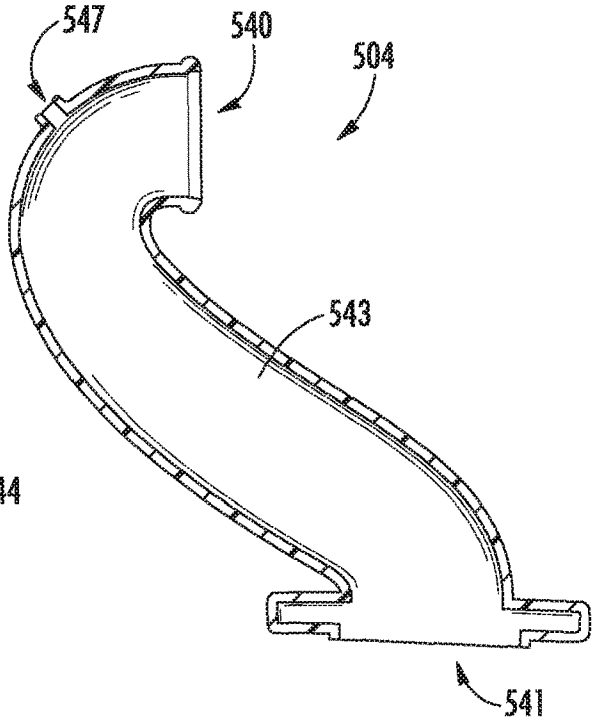
FIG. 7 is a cross-sectional side view of another exemplary embodiment of a passageway for use in a pre-primed siphonic toilet.

FIG. 7 shows another generally S-shaped passageway 504 that extends from an inlet opening 540 to an outlet 541. The passageway 504 includes a generally straight portion 543 provided between a semi-circular portion and an outlet portion. The generally straight portion 543 has a size that gradually increases moving from the end adjacent the semi-circular portion to the end adjacent the outlet portion. As shown in FIG. 7, a pre-prime inlet 547 is disposed in the passageway 504 at a location that is upstream from the generally straight portion 543 and downstream from the inlet 540. It is noted that the pre-prime inlet 547 can be located elsewhere in the passageway 504.

FIG. 8 shows a passageway 604 having an inlet portion 640 extending between an inlet opening 641 and a dam 642. The passageway 604 also has an outlet portion 643 extending from the dam 642 to an outlet 644. The outlet portion 643 has a down leg 645 extending from the dam 642 to a cross leg 646. As shown, the down leg 645 extends generally vertically downward, and the cross leg 646 extends generally horizontal. A bulge 647 is provided in the down leg 645 creating a non-linear shape. As shown, the bulge 647 has a small indentation (shown at the left side in FIG. 8) that has a generally V-shape. The side of the bulge 647 opposite the indentation is semi-circular or arcuate. The passageway 604 includes a pre-prime inlet 649, such as at a location that is upstream from the bulge 647 and downstream from the inlet portion 640. It is noted that the pre-prime inlet 649 can be located elsewhere in the passageway 604, such as downstream of the bulge 647.

FIG. 9 shows a passageway 654 having an inlet portion 660 with an inlet opening 661. The inlet portion 660 includes a semi-circular portion and an up leg that extends from the semi-circular portion to a dam 662. The passageway 654 includes an outlet portion 663 extending from the dam 662 to an outlet 664. The outlet portion 663 includes two more semi-circular portions that form a generally S-shape with the dam 662. As shown, the passageway 654 also includes a flange 665 extending around the outlet 664. The flange 665 has a generally larger size (e.g., diameter) compared to the size of the outlet portion 663. The size of the flange 665 may be tailored to the size of a drain pipe (not shown in FIG. 9) for coupling the passageway 654 to the drain pipe. The passageway 654 includes a pre-prime inlet 667, such as at a location that is upstream from the outlet portion 663 and downstream from the dam 662. It is noted that the pre-prime inlet 667 can be located elsewhere in the passageway 654.

FIG. 10 shows a tubular passageway 704 having an inlet portion 740 with an inlet opening 741 fluidly connected to a toilet bowl 703. The inlet portion 740 includes a semi-circular portion and an up leg that extends from the semi-circular portion to a dam 742. The passageway 704 includes an outlet portion 743 extending from the dam 742 to an outlet 744. The outlet portion 743 includes a down leg and a cross leg extending from the down leg to the outlet 744. Disposed in the outlet portion 743 (e.g., in the down leg and/or cross leg) is at least one rib that extends inwardly from the side wall of the tubular passageway 704. As shown, the rib 745 has spiral shape (e.g., helical or a helix shape) moving from the top of the down leg adjacent the dam 742 down toward, into, or through the cross leg. The rib 745 may be located between the dam 742 and a valve for retaining a volume of pre-priming water. The rib 745 may slow the exit (e.g., rate) of pre-primed water. This arrangement may advantageously influence (e.g., extend) the timing to complete the siphon, which may remove more waste through a longer siphon. Thus, the timing of the siphon can be influenced by the system, such as the shape (e.g., geometric configuration) of the passageway. The passageway 704 includes a pre-prime inlet 747, such as at a location that is upstream from the rib(s) 745 and downstream from the dam 742. It is noted that the pre-prime inlet 747 can be located elsewhere in the passageway 704, such as downstream from one or more rib(s) 745.

FIG. 11 shows a passageway 804 fluidly connecting a toilet bowl 803 and a drain pipe 808. The passageway 804 includes an inlet portion 840 located upstream of a dam 842 and an outlet portion 843 located downstream from the dam 842. The inlet portion 840 includes an up leg extending from an outlet of the bowl 803 to the dam 842. The outlet portion 843 includes an upper portion 844 extending from the dam 842 to a lower portion 845, which is configured having a larger cross sectional size (e.g., diameter) compared to a size of the upper portion. The size of the lower portion 845 may be tailored to hold a predetermined volume of water. As shown, the lower portion 845 includes a first (e.g., cylindrical) portion disposed at the top and a second (e.g., tapered, frusto-conical) portion extending from the first portion to the drain pipe 808. Disposed in the passageway 804 is a pre-prime inlet 847 that is configured to introduce water into the passageway 804 to pre-prime the passageway 804. As shown in FIG. 11, the pre-prime inlet 847 is disposed in the upper portion 844 of the outlet portion 843 upstream from the lower portion 845 of the outlet portion 843 and downstream from the inlet portion 840. It is noted that the pre-prime inlet 847 can be located elsewhere in the passageway 804, such as depending on the water level in the passageway 804. For example, the pre-prime inlet 847 may be provided above the water level, so for the water level WL', the pre-prime inlet 847 may be located anywhere above the water level WL'.

A valve 805 may be located in the lower portion of the outlet portion 843. As shown in FIG. 11, the valve 805 is located at the bottom base of the lower portion of the outlet portion 843 where the lower portion meets the drain pipe 808. The valve 805 includes a valve door 850 (e.g., flapper) that is moveable between a closed position and an open position. For example, the valve door 850 may rotate about a pivot 851 between the open and closed positions. In the closed position, the valve door 850 seals the exit of the passageway 804 from the drain pipe 808 to prevent the transfer of water and waste from the passageway 804 to the drain pipe 808. The valve door 580 is configured to retain a volume of water in the closed position to pre-prime the toilet prior to the next flush cycle. In the open position, the valve door 850 allows water and waste to pass from the passageway 804 into the drain pipe 808. The water level WL can be changed to influence the siphon during the flush cycle, such as to the alternate levels shown using WL' and WL" in FIG. 11.

FIG. 12 shows a passageway 904 fluidly connecting a toilet bowl 903 and a drain pipe 908. The passageway 904 has a shape that is substantially similar to the shape of the passageway 104 shown in FIG. 2, except where noted otherwise. The water level can be tailored to affect the performance of the flush cycle. As non-limiting examples, the water level can be at the height indicated by WL, WL', or WL" as shown in FIG. 12. A valve may be disposed in the passageway 904 to retain a volume of water therein to pre-prime the flush cycle of the toilet having the passageway 904. The valve may be located anywhere within the cross-hatching shown in FIG. 12, including at the outlet of the passageway 904 or in the drain pipe 908. For example, the valve may be integrated with a floor flange configured to secure the passageway 904 and the drain pipe 908. Disposed in the passageway 904 is a pre-prime inlet 947 that is configured to introduce water into the passageway 904 to pre-prime the passageway 904. As shown in FIG. 12, the pre-prime inlet 947 is disposed above the water level WL" and downstream from an inlet portion 940. It is noted that the pre-prime inlet 947 can be located elsewhere in the passageway 904, such as depending on the water level in the passageway 904. For example, the inlet may be located at the location shown for the inlet 947', such as for an embodiment configured to fill water in the passageway 904 to the water level WL.

A valve, such as the valve 105, 205, 208, 805, can be located anywhere in the passageways shown in FIGS. 5-12. Furthermore, more than one valve can be used with each of the passageways shown in FIGS. 5-12.

An exemplary method of flushing a toilet, such as the toilets 101, 201, will now be described. The method includes (e.g., as a first step) filling and retaining a first volume of water in a bowl and/or an up leg of a passageway that is downstream from the bowl and upstream from a dam. The first volume of water may be retained in the toilet by the geometry (e.g., configuration, shape, etc.) of the bowl, the passageway, a valve (e.g., the second valve 208), another element/feature, or any combination thereof.

The method includes (e.g., as a second step) filling and retaining a second volume of water in the passageway between a valve and the dam. For example, the valve may retain the second volume of water in the passageway when in a closed position. The second volume of water may be introduced into the passageway using a flow control device, which may be configured to meter out a specific amount of water. According to an embodiment, the second volume of water is introduced into the passageway prior to the activating the flush cycle through an inlet in the passageway (e.g., a pre-prime inlet), which is located downstream of the dam and upstream from the valve.

The method includes (e.g., as a third step) activating a flush cycle of the toilet. The activation of the flush cycle may be configured to introduce a third volume of water into the bowl, such as through a rim channel, jet, other suitable element/feature, or combination thereof. The activation of the flush cycle moves the valve retaining the pre-prime volume of water from the closed position to an open position to affect a siphon during the flush cycle. If the toilet includes more than one valve, such as the second valve 208, then the second valve can be moved to an open position upon activation of the flush cycle. The order between the opening of the valves (for toilets having more than one valve) may be tailored, such as to affect the siphon.

The method may also include venting (e.g., releasing) air through a release line (e.g., an air pressure release line). The release line may extend between a first opening in the passageway, which is upstream from the inlet and/or downstream of the dam, and a second opening in the passageway, which is downstream of the valve. Further, when the valve is in the open position the valve may be configured to seal off the second opening in the passageway to prevent the flow of water and waste into the air pressure release line.

The method may also include closing the valve (or valves if more than one valve is used during the flush cycle). The valve may be closed after evacuation of the water and waste. If the toilet includes more than one valve, the order in closing the valves may be tailored.

The method may also include introducing water into the system to pre-prime the toilet for a subsequent flush cycle. For example, the valve in the passageway for pre-priming may be closed after evacuation of the water and waste, then water may be introduced into the passageway (e.g., through the inlet) to pre-prime the toilet.

The pre-primed siphonic toilet, as disclosed herein, provide multiple advantages/benefits, some of which are described above. Another such advantage is that the toilets can operate without a tank (i.e., the toilets of this this application can be configured as "tankless" toilets) thereby reducing size and cost (e.g., material, labor, packaging, etc.) and allowing for more freedom of design regarding the toilets. The system (e.g., the flushing engine) is a "line pressure system" since it can be configured to operate based on line pressure, as opposed to "gravity flushing systems" that rely on gravity to operate. In addition to utilizing line pressure for flushing, the systems disclosed herein may also utilize line pressure for other functions, such as those that would otherwise require electronics and a power source.

As discussed above, the toilets of this application enable the use of grey-water in the flushing system without degrading performance or exposing the customer to "grey" or possibly contaminated water. From a user's perspective, the toilets appear as conventional toilets utilizing only fresh water, but use far less fresh water when using grey water, such as for the pre-priming. Thus, the grey-water toilets appear and function at least as well as a standard line fed toilet. The grey water toilets of this application can be configured both with and without a conventional tank.

Also, the toilets of this application are configured to reduce the total volume of water used for each flush cycle of solid and/or liquid waste. This is in addition to being able to drastically reduce the volume of fresh water used for each flush cycle, such as by using grey water for pre-priming the passageway.

Also, the toilets of this application are able to reduce the time (e.g., actual time in seconds) it takes to complete each flush cycle. For example, the pre-priming eliminates the amount of time that conventional toilets take to prime after activation of the flush cycle. Thus, by pre-priming the passageway of the toilet, the priming phase of the flush is eliminated or reduced to a fraction of the time required in a traditional toilet design.

The pre-primed traps/trapways/passageways of this application function differently than toilets that, for example, use existing line pressure for flushing. For example, the pressurized water from the supply does not have to be used directly to push the waste from the bowl. Instead, the pressurized water may be used to control secondary functions of the toilet/system, which can be designed to function on as little as approx. 1-5 psi and less than 1 gpm of flow. Line pressure toilets may require the jet in the sump to move/push the solid waste upward into the trapway, while also providing a high enough flow rate of water to prime the trapway (i.e., introduce the water into the trapway during the flush cycle) and create a siphon to evacuate the bowl. At low pressure and flow rate (e.g., approximately less than 35 psi and 2 gpm) these systems typically begin to perform poorly and will fail to perform at rates much higher than 5 psi and 1 gpm. A common line pressure toilet may fail to remove solid waste at 20 psi and 3 gpm.

For the toilets having pre-primed traps/trapways/passageways, the trapway is sealed off, such as, for example, at the outlet using a valve that can be opened and closed when desired. The features/elements of the valve (e.g., openings, etc.) are large enough to not obstruct the flow of waste and water from the system when opened. The trapway can be filled with water to a predetermined level while the valve is closed. While at rest (e.g., between flush cycles) the trapway remains filled with water (e.g., pre-primed). Pressure and flow rate supplied (e.g., fluctuations thereof) do not affect waste removal performance of the toilets/systems of this application. Low pressure and flow supplied to toilets/systems of this application may increase the amount of time required to fill the trapway (e.g., the time to pre-prime the trap) between flushes, but would not detrimentally impact performance (e.g., waste/water removed with each flush). This is advantageous, because the toilets of this application will not fail to flush or fail to siphon at low pressure/flow.

The major components of the toilets of this application may be configured to operate or control operation of the primary and secondary functions, which can be designed in any number of different embodiments, such as any toilet disclosed herein. In an embodiment, the secondary functions that control the opening and closing of the valve in the passageway (e.g., the valve 105), timing of rim wash, and actuating the flush can all be controlled with water pressure. Accordingly, the entire system may be designed to function without electrical components.

In another embodiment, one or more than one electronic components may be used to control some or all of the toilets/systems functions. By way of example, an electric motor can be used to open and close the valve in the passageway (e.g., the valve 105). Solenoids and a simple circuit with programming can be used to control rim wash, bowl and trap refill, and/or operating a hydraulic piston to open and close the trap valve. Electromagnetic field or other proximity sensors can be used to achieve desired functions, and timing said functions. It is noted that various combinations of electronic and hydraulic functions may be utilized with the toilets of this application.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the siphonic toilets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., passageway, leg, valve, flow control, air pressure release line, pre-prime inlet, electromagnet, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A method of flushing a siphonic toilet, comprising:

retaining a first volume of water in a bowl and an up leg of a passageway that is upstream from a dam;

retaining a second volume of water in the passageway between a valve and the dam in a closed position of the valve;

activating a flush cycle of the siphonic toilet that introduces a third volume of water into the siphonic toilet; and moving the valve from the closed position to an open position to affect a siphon during the flush cycle.

2. The method of claim 1, wherein the second volume of water is introduced into the passageway using a flow control device prior to the activating the flush cycle through an inlet located downstream of the dam and upstream from the valve.

3. The method of claim 2, further comprising venting air through an air pressure release line extending between a first opening in the passageway, which is upstream from the inlet and downstream of the dam, and a second opening in the passageway, which is downstream of the valve.

4. The method of claim 3, wherein when the valve is in the open position, the valve seals off the second opening, and when the valve is in the closed position, the second opening is exposed.

5. The method of claim 3, further comprising preventing water and waste from back flowing through the air pressure release line during a flush cycle through a check valve located in line with the air pressure release line.

6. The method of claim 5, wherein the check valve is located proximate the first opening of the passageway.

7. The method of claim 6, wherein the check valve is a first check valve, and further comprising a second check valve proximate the inlet of the passageway.

8. The method of claim 5, wherein the valve is a first valve, and the first volume of water is retained by a second valve located upstream of the dam.

9. The method of claim 8, wherein the second valve retains the first volume of water in a closed position of the second valve.

10. The method of claim 9, further comprising moving the second valve from the closed position to an open position to affect the siphon during the flush cycle, wherein the first and second valves are moved to the open position in response to activating the flush cycle.

11. A method of flushing a siphonic toilet, comprising:

retaining a first volume of water upstream of a dam of a passageway, the passageway fluidly connecting an outlet of a bowl and an outlet of the siphonic toilet;

retaining a second volume of water in the passageway downstream of the dam through a valve located between the dam and the outlet of the siphonic toilet;

activating a flush cycle that introduces a third volume of water into at least one of the bowl and the passageway; and moving the valve from a closed position to an open position to affect a siphon during the flush cycle.

12. The method of claim 11, wherein the second volume of water is introduced into an inlet of the passageway using a flow control device prior to the activating the flush cycle, and wherein the inlet is located downstream of the dam and upstream from the valve.

13. The method of claim 12, wherein the valve is a first valve, and the first volume of water is retained by a second valve located upstream of the dam.

14. The method of claim 13, wherein the second valve retains the first volume of water in a sump of the bowl in a closed position of the second valve.

15. The method of claim 14, further comprising moving the second valve from the closed position to an open position to affect the siphon during the flush cycle.

16. The method of claim 15, wherein the first and second valves are moved to the open position in response to activating the flush cycle.

17. The method of claim 16, further comprising venting air through an air pressure release line extending between a first opening in the passageway, which is upstream from the inlet and downstream of the dam, and a second opening in the passageway, which is downstream of the first valve.

18. The method of claim 17, wherein the first valve seals off the second opening in the open position of the first valve, and the second opening is exposed in the closed position of the first valve.

19. The method of claim 14, wherein the second valve is located in an inlet end of the passageway fluidly connected to the outlet of the bowl.

20. The method of claim 11, further comprising venting air through an air pressure release line extending between a first opening in the passageway, which is upstream from an inlet of the passageway and downstream of the dam, and a second opening in the passageway, which is downstream of the valve.

* * * * *